United States Patent [19]

Biggio

[11] Patent Number: 4,860,891

[45] Date of Patent: Aug. 29, 1989

[54] PAINT AND BRUSH HOLDER

[76] Inventor: Raymond Biggio, 1115 7th St., West Babylon, N.Y. 11704

[21] Appl. No.: 194,502

[22] Filed: May 16, 1988

[51] Int. Cl.[4] ..... B65D 25/10

[52] U.S. Cl. ..... 206/362; 15/257.05; 206/209; 211/66; 220/90

[58] Field of Search ..... 15/257.05, 257.06; 206/207, 209, 229, 361, 362; 211/65, 66, 70.6; 220/85 D, 90

[56] References Cited

U.S. PATENT DOCUMENTS

| | | | |
|---|---|---|---|
| 1,323,996 | 12/1919 | Yearwood | 211/65 |
| 1,426,622 | 8/1922 | Ward | 206/209 |
| 2,472,001 | 5/1949 | Buhoveckey | 206/209 |
| 3,252,613 | 5/1966 | McGrath | 15/257.05 |
| 3,351,970 | 11/1967 | Engh | 15/257.06 |
| 3,527,341 | 9/1970 | Peebles | 206/209 |
| 3,829,926 | 8/1974 | Salladay | 15/257.06 |
| 3,837,034 | 9/1974 | Leffert et al. | 15/257.06 |
| 4,275,818 | 6/1981 | Church | 15/257.05 |
| 4,756,439 | 7/1988 | Perock | 220/90 |
| 4,771,501 | 9/1988 | Leiter | 15/257.05 |

*Primary Examiner*—Jimmy G. Foster
*Attorney, Agent, or Firm*—Michael I. Kroll

[57] ABSTRACT

A paint and brush holder is provided and consists of an elongated housing for supporting a paint brush in a vertical position over a paint reservoir base with paint brush bristles facing downwardly so that in one situation paint can drip from the bristles back into the paint reservoir base and in another situation paint can cover the bristles to keep them moist when the paint brush is not being used during a short period of time.

5 Claims, 1 Drawing Sheet

Figure 1
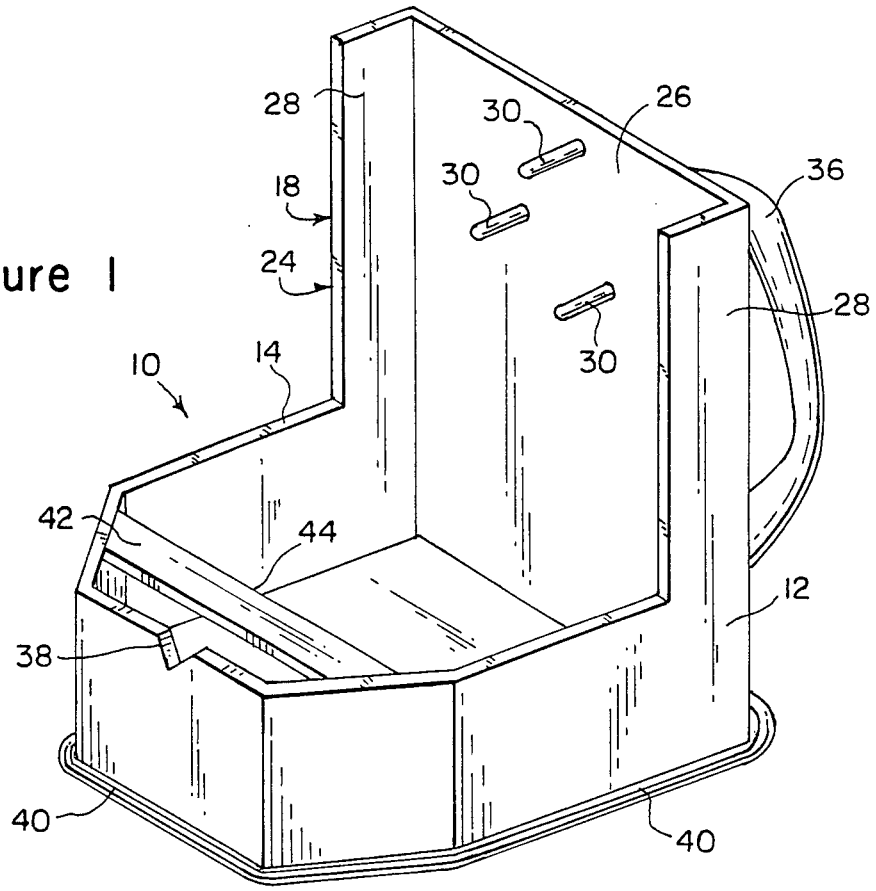
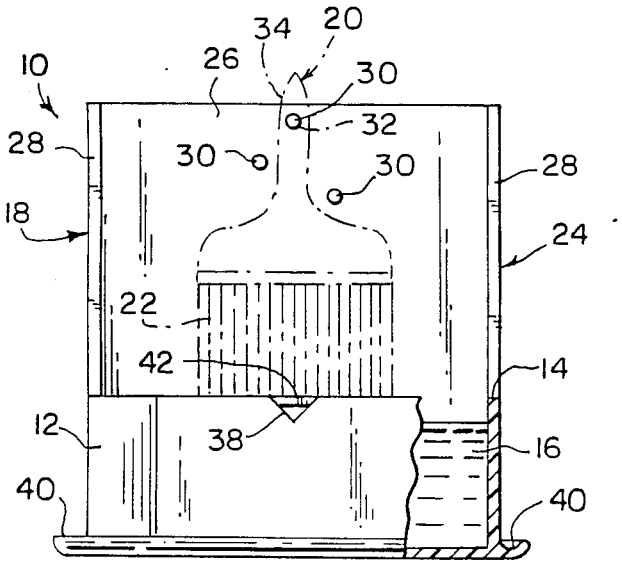
Figure 2

PAINT AND BRUSH HOLDER

BACKGROUND OF THE INVENTION

1. Field of the Invention

The instant invention relates generally to painting tools and more specifically it relates to a paint and brush holder.

2. Description of the Prior Art

Numerous painting tools have been provided in prior art that are adapted to be used in the performance of the process of coating surfaces with paint for a utilitarian effect. While these units may be suitable for the particular purpose to which they address, they would not be as suitable for the purposes of the present invention as heretofore described.

SUMMARY OF THE INVENTION

A primary object of the present invention is to provide a paint and brush holder that will overcome the shortcomings of the prior art devices.

Another object is to provide a paint and brush holder in which the paint brush is vertically suspended thereon to extend into a paint reservoir base so that the paint brush bristles will be kept moist in the paint.

An additional object is to provide a paint and brush holder in which one of various sized paint brushes can be vertically suspened from one of a plurality of different level positioned pins so that the paint brush bristles will always contact the paint therein when the paint brush is not being used during a short period of time.

A further object is to provide a paint and brush holder that is simple and easy to use.

A still further object is to provide a paint and brush holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the invention.

FIG. 2 is a front view thereof with parts broken away.

DETAILED DESCRIPTION OF THE PREFERRED EMBODIMENTS

Turning now descriptively to the drawings, in which similar reference characters denote similar elements throughout the several views, FIGS. 1 and 2 illustrate a paint and brush holder 10 which contains a paint reservoir base 12 that has an open top 14 for holding paint 16 therein. A structure 18 is provided for supporting a paint brush 20 in a vertical position over the paint reservoir base 12 with bristles 22 facing downwardly. In one situation the paint 16 can drip from the bristles 22 back into the paint reservoir base 12. In another situation the paint can cover the bristles 22 to keep them moist when the paint brush 20 is not being used during a short period of time.

The paint brush supporting structure 18 is an elongated C-shaped housing 24 extending vertically upwardly from the open top 14 at rear of the paint reservoir base 12. The housing 24 has a rear wall 26 and a pair of side walls 28. A plurality of pins 30 are affixed at different levels in a zig-zag arrangement to the rear wall 26 of the housing 24 so that one of various sized paint brushes 20 can be vertically suspended on one of the pins 30 by a paint brush handle 32 having a hole 34 therethrough.

A hand grip handle 36 is disposed at rear thereof so that a person (not shown) can easily carry the holder 10. The paint reservoir base 12 has a notched out spout 38 disposed at front of the open top 14 so that the paint 16 can be poured out therefrom. A drip lip 40 is disposed around lower exterior perimeter of the paint reservoir base 12 to catch any of the paint 16 that is poured out therefrom.

A thin platform 42, having an inner edge 44, extends across the open top 14 of the paint reservoir base 12 near the spout 38 so that the bristles 22 of the paint brush 20 can be wiped against the inner edge 44 thereof allowing the paint 16 on the bristles 22 to drip back into the paint reservoir base 12.

LIST OF REFERENCE NUMBERS

10 paint and brush holder
12 paint reservoir base
14 open top
16 paint
18 structure
20 paint brush
22 bristles
24 elongated C-shaped housing
26 rear wall
28 side wall
30 pin
32 paint brush handle
24 hole
36 hand grip handle
38 notched out spout
40 drip lip
42 thin platform
44 inner edge It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and is desired to be protected by Letters Patent is set forth in the appended claims:

1. A paint and brush holder which comprises:

(a) a paint reservoir base having an open top for holding paint therein; and (b) means for supporting a paint brush in a vertical position over said paint reservoir base with bristles facing downwardly so that in one situation the paint can drip from the bristles back into said paint reservoir base and in another situation the paint can cover the bristles to keep them moist when the paint brush is not being used during a short period of time, said paint brush supporting means comprising an elongated C-shaped housing having a rear wall and a pair of side walls and extending vertically upwardly from the open top at rear of said paint reservoir base, and a plurality of pins affixed at different levels in a zig-zag arrangement to the rear wall of said housing so that one of various sized paint brushes can be vertically suspended on one of said pins by a paint brush handle having a hole therethrough.

2. A paint and brush holder as recited in claim 1, further comprising a hand grip handle disposed at rear thereof so that a person can easily carry said holder.

3. A paint and brush holder as recited in claim 2 further comprising said paint reservoir base having a notched out spout disposed at front of the open top so that the paint can be poured out therefrom.

4. A paint and brush holder as recited in claim 3 further comprising a drip lip disposed around lower exterior perimeter of said paint reservoir base to catch any of the paint that is poured out therefrom.

5. A paint and brush holder as recited in claim 4, further comprising a thin platform member having an inner edge extending across the open top of said paint reservoir base near said spout so that the bristles of the paint brush can be wiped against the inner edge thereof, allowing the paint on the bristles to drip back into said paint reservoir base.

* * * * *